US005167086A

United States Patent [19]

Fast

[11] Patent Number: 5,167,086

[45] Date of Patent: Dec. 1, 1992

[54] SPIRAL INFORMATION TAG HOLDER

[76] Inventor: Jacob Fast, 7561 NW. 9th St., Plantation, Fla. 33317

[21] Appl. No.: 365,859

[22] Filed: Jun. 14, 1989

[51] Int. Cl.[5] ..... G09F 3/06

[52] U.S. Cl. ..... 40/299; 24/16 PB; 24/30.5 S; 40/645; 40/665

[58] Field of Search ..... 40/665, 316, 645, 299, 40/310; 24/16 R, 16 PB, 30.5 R, 30.5 S, 30.5 P, 131 C

[56] References Cited

U.S. PATENT DOCUMENTS 3,775,882 12/1973 Wheeler ..... 40/645
4,570,368 2/1986 Stover ..... 40/645

FOREIGN PATENT DOCUMENTS 221283 7/1968 Sweden ..... 40/316
928752 6/1963 United Kingdom ..... 40/645

*Primary Examiner*—James R. Brittain
*Attorney, Agent, or Firm*—Jacobson, Price, Holman & Stern

[57] ABSTRACT

An information tag holder for use on a stem or a limb of a growing plant, bush or tree has a spiral gripping portion which is used to embrace the stem or limb and securely retain the holder thereon. The spiral nature of the structure accommodates increase in diameter of the limb or stem as the article grows so that the tag holder is retained on the stem or limb during such growth.

7 Claims, 1 Drawing Sheet

FIG. 1
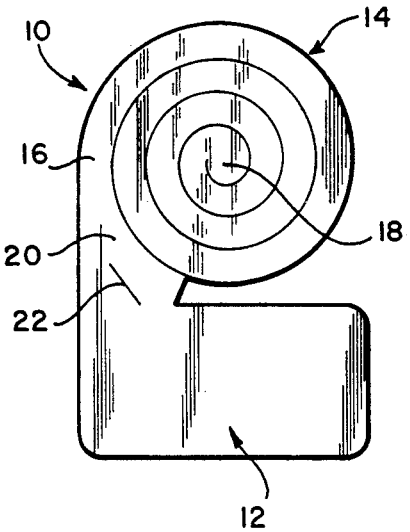
FIG. 2
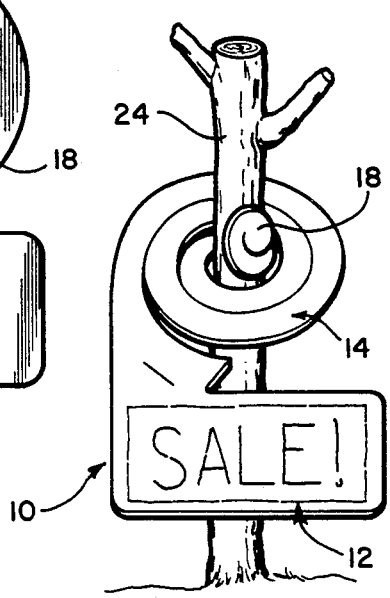
FIG. 3
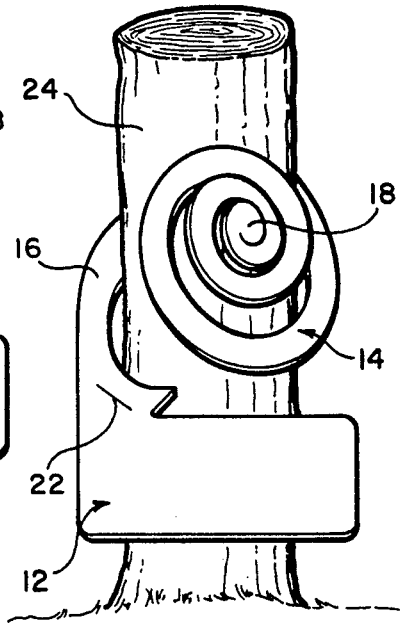
FIG. 4
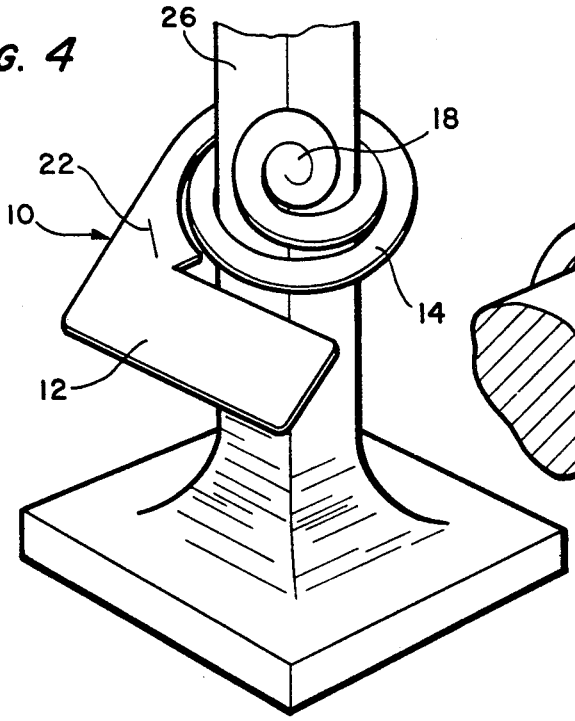
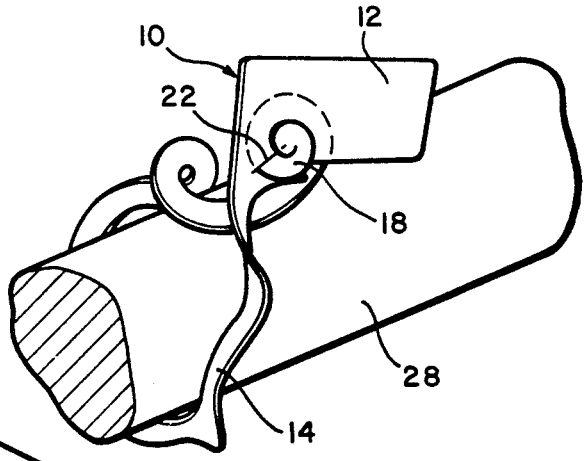
FIG. 5

SPIRAL INFORMATION TAG HOLDER

BACKGROUND AND SUMMARY OF THE INVENTION

This invention relates to a spiral information tag holder, particularly for labeling stem-like articles, more especially in the agricultural environment, but not exclusively for this use.

For example, the holder is particularly useful for tagging or labeling trees, bushes or other plants in nurseries and the like, in a manner whereby the holder will remain in place on a stem or limb of a plant as the plant grows and the stem or limb increases in diameter. In this regard, it may be stated that is somewhat problematical to provide a tag structure which can be used efficiently on the stem of a growing plant or the like to accommodate increases in diameter of the stem as the plant grows. It is an object of the present invention to provide a tag holder suitable for this purpose, but also suitable for use with other stem-like articles where the stem diameter does not change in time.

In accordance with the invention, therefore, there is provided an information tag holder of sheet material, such as plastic sheet, the holder comprising an information-carrying portion and a stem gripping portion substantially in the form of a spiral having an outer end connected with the information-carrying portion and a free inner end.

In use, to apply the holder to a stem-like article, it is merely necessary to open out adjacent portions of the spiral and press the opened out section onto the stem-like article from one side. Then, the holder can be rotated about the article toward the inner end of the spiral until a point is reached where the stem-like article is tightly gripped in an appropriate section of the spiral. The tag holder will then securely grip the stem-like article. Further, as the stem-like article increases in diameter, it will gradually work its way outwardly along the spiral to accommodate such increase due to the progressively larger spiral diameter so that the grip on the stem-like article is maintained.

In an alternative manner of applying the holder to a stem-like article, it can be threaded onto the stem-like article from one end of the stem-like article if this is appropriate.

In a preferred form of the invention, a slit may be provided substantially at a junction between the outer end of the spiral and the information-carrying portion of the holder. For stem-like articles which may be too large to be accommodated at any point of the spiral, the spiral can be entirely pulled out to its full extent and wound around the stem-like article with the inner end of the spiral being inserted through and gripped in the slit. Thus, the use of the device is further extended to suit over-sized stems and the like.

Additional features and advantages of the invention will be apparent from the ensuing description and claims read in conjunction with the attached drawings.

BRIEF DESCRIPTION OF THE DRAWINGS

FIG. 1 is a face view of a spiral information tag holder in accordance with the invention;

FIG. 2 is a perspective view of a small tree, bush or the like during its initial growing stage with a holder in accordance with the invention applied thereto;

FIG. 3 is a view similar to FIG. 2 showing the tree or bush after a period of growth when its stem diameter has increased;

FIG. 4. is a perspective view of the bottom portion of a lamp base with a holder in accordance with the invention attached thereto; and FIG. 5 is a perspective view of a large-diameter stem-like article showing the holder attached thereto.

DESCRIPTION OF PREFERRED EMBODIMENT

Referring initially to FIG. 1 there is shown a generally flat and planar an information tag holder 10, which may be die-cut in plastic sheet material of a type generally well known for use in labeling and like applications. The holder 10 has a generally rectangular information-carrying portion 12 and a stem-gripping portion 14 in the form of a spiral with an outer end 16 and a free inner end 18. The outer end 16 of the spiral is connected to the information-carrying portion 12 at a junction 20. Furthermore, there is an inclined slit 22 formed in the junction, the slit being long enough to receive the headed inner end 18 of the spiral therethrough.

To attach the holder to the stem 24, for example of a small tree or bush in a nursery or the like, the spiral 14 maybe opened out at any convenient place along its length and the opened out section thereof maybe worked onto the stem 24 from one side. Then, the holder 10 maybe rotated around the stem 24 toward the inner end 18 of the spiral until an appropriate point on the spiral is reached at which it tightly grips the stem 24 as shown in FIG. 2.

As the stem 24 increases in diameter when the tree or bush grows, it will work its way around the spiral toward the outer end 16 thereof as shown in FIG. 3 so that the grip of the holder is still securely retained on the stem 24 and the information-carrying portion 12 is thus securely retained on the stem.

It will be understood that in the manner described above, the holder accordingly adjusts to any size stem within the range of the spiral and will not, for example, squeeze the limbs or stems of delicate plants because of the its capacity to accommodate the increase in diameter thereof during growth. The device is simple to place around a limb or stem and also to remove.

While the invention has been described above as being applicable to the stem of a plant, tree, or the like, it is apparent that is equally applicable for use on any limb of the plant.

FIG. 4 shows how the holder 10 may be applied to other commercial articles, FIG. 4 for example showing the device applied to a rectangular section lamp base 26 which does not increase in diameter.

For articles 28 which may be larger in diameter than the capacity of the spiral when used in the manner described above, the spiral may alternatively be pulled out to its full length, wound around the article 28 and have the head 18 inserted through slit 22 so as to retain the holder in place around the article in the manner of an encircling band.

While only preferred embodiments of the invention have been described herein in detail, the invention is not limited thereby and modifications can be made within the scope of the attached claims.

What is claimed is:

1. An information tag holder of sheet material for use on a stem-like or limb-like member, the holder comprising an information-carrying portion, and a gripping portion connected to the information carrying portion and having a spiralling cut therein which forms a spiral having an outer end connected to the information-carrying portion and a free inner end.

2. The invention of claim 1 wherein the information-carrying portion is of rectangular form and the outer end of the spiral is connected to the information-carrying portion at one corner thereof.

3. The invention of claim 1 wherein the outer end of the spiral is connected to the information-carrying portion through a junction which includes a slit for inserting the inner end of the spiral through when the spiral is pulled out.

4. In combination with a stem-like or a limb-like member, an information tag holder of sheet material comprising an information-carrying portion and a stem-gripping portion connected to the information carrying portion and having a spiralling cut therein which forms a spiral having an outer end connected to the information-carrying portion and a free inner end, said member being embraced by and gripped between adjacent radial portions of the spiral.

5. The invention of claim 4 wherein the information-carrying portion is of rectangular form and the outer end of the spiral is connected to the information-carrying portion at one corner thereof.

6. The invention of claim 4 wherein the outer end of the spiral is connected to the information-carrying portion through a junction which includes a slit for inserting the inner end of the spiral through when the spiral is pulled out.

7. In combination with a stem-like or limb-like member, an information tag holder of sheet material comprising an information-carrying portion and a stem-gripping portion connected to the information carrying portion and having a spiralling cut therein which forms a spiral having an outer end connected to the information-carrying portion and a free inner end, the spiral being connected to the information-carrying portion through a junction which includes a slit for receiving the inner end of the spiral, the spiral being pulled out and wound around said member and the free inner end of the spiral being inserted through said slit for retaining the holder on said member.

* * * * *